United States Patent [19]

Marcellus

[11] 4,409,703

[45] Oct. 18, 1983

[54] CREOSOTE CUTTER

[76] Inventor: Leland D. Marcellus, P.O. Box 657, Unadilla, N.Y. 13849

[21] Appl. No.: 232,556

[22] Filed: Feb. 9, 1981

[51] Int. Cl.[3] ..... F23J 3/00

[52] U.S. Cl. ..... 15/249; 15/243

[58] Field of Search ..... 15/162, 163, 242, 243, 15/249, 104.3 R, 104.16

[56] References Cited

U.S. PATENT DOCUMENTS

| | | | |
|---|---|---|---|
| 282,775 | 8/1883 | Resor | 15/249 |
| 1,069,826 | 8/1913 | Smith | 15/249 |
| 1,184,784 | 5/1916 | Steiner | 15/249 |
| 1,320,887 | 11/1919 | Michels, Sr. | 15/249 |
| 4,028,769 | 6/1977 | Coviello et al. | 15/249 |
| 4,138,758 | 2/1979 | Dodge et al. | 15/243 |
| 4,185,351 | 1/1980 | Radsavitch | 15/243 |
| 4,340,989 | 7/1982 | Rotondi et al. | 15/249 |

FOREIGN PATENT DOCUMENTS

| | | | |
|---|---|---|---|
| 3841 | of 1912 | United Kingdom | 15/104.3 R |
| 107278 | of 1916 | United Kingdom | 15/249 |
| 119433 | 7/1918 | United Kingdom | 15/249 |
| 162194 | 5/1920 | United Kingdom | 15/249 |

*Primary Examiner*—Edward L. Roberts

[57] ABSTRACT

A chimney cleaner is designed to be permanently installed in a chimney and is secured to a topmost portion of the chimney through the use of an adjustable mounting assembly. The chimney cleaner is primarily designed for removing creosote and the mounting assembly for the cleaner includes a small pulley fastened to a carrying bar, such carrying bar being positioned over the topmost portion of the chimney through the use of upstanding support arms with the pulley serving to retain a chain or other flexible pulling means on which a creosote cutter may be hung. The cutter is provided with at least one serrated edge to facilitate the creosote removing operation, and a second chain may be hung from the bottommost portion of the cutter to permit a dislodging of the cutter in the event that it becomes jammed within the chimney. In one embodiment, the chimney cleaner may be operated from outside of the chimney, while in a second embodiment, an operating chain is provided within the chimney. With respect to the second embodiment, a second mounting assembly is provided for use with the first mounting assembly and includes a pair of guide eyes through which the operating chain may be directed, and the use of an eyebolt permanently attached to several pieces of angle iron, such eyebolt being extensible in length so as to wedge the angle iron firmly in position within the cleanout compartment of the chimney.

4 Claims, 10 Drawing Figures

CREOSOTE CUTTER

BACKGROUND OF THE INVENTION

1. Field of the Invention

The present invention relates generally to chimney cleaners and more particularly pertains to a new and improved chimney cleaner which is designed primarily for removing creosote and which may be permanently installed within a chimney without any danger of interference with a combustion process occurring therein.

2. Description of the Prior Art

The use of chimney cleaners is generally well known in the art. In this respect, a typical example of a prior art chimney cleaner is to be found in U.S. Pat. No. 4,028,769, which issued to Coviello et al. on June 14, 1977, wherein an apparatus for cleaning chimney flues and the like is disclosed. The Coviello et al. apparatus includes a pulley mounting structure which engages and is secured on an upper edge portion of a chimney flue together with a rope extending through the pulley and having a chimney cleaning device secured thereto. Basically, the Coviello et al. device consists of an eyebolt secured to a metal plate which is somewhat smaller than the inside dimensions of the flue, and the metal plate is then secured to a flexible plate which is slightly larger than the inside dimensions whereby the flexible plate sweeps along the inside of the chimney flue to remove creosote and carbon buildup therefrom. In one embodiment, the cleaning apparatus is provided with sawtooth edges along the outside portion of the flexible plate so as to further facilitate the chimney cleaning operation.

Inasmuch as the Coviello et al. apparatus does facilitate the cleaning of a chimney flue, certain disadvantages in its construction are evident. For example, the flat plate construction of the cleaning portion of the device completely blocks the chimney flue so as to prevent the use of the cleaner during such time as a combustion process is occurring within an associated furnace. Accordingly, the chimney cleaning apparatus cannot be permanently mounted within a chimney, thus greatly increasing the trouble and complexity associated with a cleaning operation. By the same token, the cleaning apparatus utilizes a mounting structure which is attached directly to the flue extending above a chimney and not to the chimney per se, thus presenting a concern regarding possible damage to the fragile porcelain construction of the flue.

There has been at least a couple of attempts to develop chimney cleaners which could be permanently installed to a chimney and which would not interfere with an ongoing combustion process. For example, U.S. Pat. No. 1,329,596, which issued to Harbort on Feb. 3, 1920, discloses a chimney cleaner which includes a topmost mounted carrying arm having a pulley centrally positioned thereon, and a chimney cleaner per se positionable within the chimney and being somewhat open and unencumbered in its construction whereby smoke could traverse up the chimney past the cleaner without substantial interference. To operate the chimney cleaner, a second pulley is utilized which is permanently affixed to a rotatable shaft bearingly supported within the chimney. In this regard, the installation of the Harbort apparatus requires that a pair of apertures be drilled through the brick construction of a chimney so that cylindrical bearing supports may be permanently installed therein. The rotatable shaft is then positionable through the bearings and a handle may be provided on an outwardly extending portion of the shaft so as to facilitate a rotation thereof. Additionally, some form of access must be provided to the interior of the chimney so that an operator can fixedly secure the second pulley on the rotatable shaft once the shaft has been longitudinally inserted through a first of the bearing members, thus making it apparent that the construction of the Harbort device is quite costly and complex, as is its attendant installation.

Another attempt at devising a chimney cleaning apparatus which may be permanently installed within a chimney is to be found in U.S. Pat. No. 4,138,758, which issued to Dodge et al. on Feb. 13, 1979, wherein there is disclosed a bracket centrally positionable over a topmost portion of a chimney, such bracket having a pulley retained thereon and serving to support, through a rope positioned thereover, a chimney cleaning brush. In this connection, the brush includes a plurality of spring loops which are quite flexible in construction and which are designed primarily for the purpose of removing soot accumulations. A weight may be provided on a bottommost portion of the brush so as to facilitate a downward movement of the brush through a chimney flue. While the open and unencumbered construction of the brush allows a combustion process to continue during a cleaning of the chimney, the extreme flexibility of the spring members associated therewith are inefficient in removing creosote accumulations. Further, the bracket assembly associated with the chimney cleaner utilizes but two support members positioned against the flue, thus presenting a substantial likelihood of damage to the flue as well as the potential of an unexpected collapse of the entire assembly. Further, the looped construction of the various springs could easily result in the same becoming snagged or lodged within a chimney flue, whereby no manner of upward or downward movement of the cleaner would dislodge the same thus requiring substantial and costly repairs.

Accordingly, it can be appreciated that there still exists a need for a chimney cleaning apparatus which may be permanently installed in a chimney, which may be securely mounted to the chimney per se as opposed to the flue portion thereof, and which may be operated concurrently with a combustion process occurring within a firebox associated therewith. In this respect, the present invention substantially fulfills this need.

SUMMARY OF THE INVENTION

The general purpose of the present invention, which will be described subsequently in greater detail, is to provide a chimney cleaner which possesses all of the advantages of the prior art chimney cleaners and none of the disadvantages. To attain this, the chimney cleaner forming the present invention utilizes a bracket mountable to a topmost portion of a chimney, such bracket serving to support a creosote cutter or cutter bar normally retained within the chimney. Specifically, the bracket may be mounted to the top of the chimney through the use of at least one strip of banding iron and includes a diagonally-positioned cross extending member from which a pulley is centrally, supportably retained over the opening of the chimney.

The creosote removing cutter bar may then be moveably supported from the pulley through the use of a flexible chain, or the like, in a manner whereby an operator may manually move the chain over the pulley to effectively move the creosote cutter up and down within the chimney. In this regard, the chain may have a cord or other similar flexible pulling means attached to the free end thereof whereby the cutter within the chimney may be operated from a position outside of the chimney, preferably at ground level. Alternatively, the flexible pulling means associated with the creosote cutter can be constructed entirely of chain whereby the same may be directed downwardly through the chimney so as to permit an operator to operate the cutter by grasping the actuating chain through an access or cleanout door normally provided with coal, wood and similar types of fireboxes. As such, it can be appreciated that the present invention envisions the use of creosote cutters which may be operated from inside or outside of a dwelling. In this regard, the inside dwelling operated creosote cutter utilizes a second bracket which is mountable within the cleanout area of the furnace, access being provided thereto through the aforementioned cleanout door, such secondary bracket including an extensible eyebolt for effecting a fixed securing of the bracket within the cleanout area and further including a pair of guide eyes through which the above described actuating chain can be slideably directed.

As to the specific construction of the creosote cutters per se, the same can be manufactured of any durable metallic material and may be designed to closely fit within the shape or contour of the chimney opening. In this connection, the central portion of the creosote cutter is substantially left open whereby no interference with the combustion gases being exhausted from the chimney will occur, and at least one edge of the cutter may be provided with serrations to further facilitate the effectiveness of the creosote removing operation. In the embodiment of the creosote cutter assembly designed for inside dwelling operation, the cutter may be provided with a centrally positioned, fixedly atttached guide tube through which the actuating chain may be directed, thereby to eliminate some of the concern regarding the possible entanglement of the actuating chain within the chimney structure per se.

It is therefore an object of the present invention to provide a creosote removing chimney cleaner that has all the advantages of the prior art chimney cleaners and none of the disadvantages.

Another object of the present invention is to provide a creosote removing chimney cleaner which is simple in its construction and which utilizes a minimum of moving parts.

Yet another object of the present invention is to provide a creosote removing chimney cleaner that may be easily and economically manufactured.

Still another object of the present invention is to provide a creosote removing chimney cleaner that is durable and reliable in its operation.

A further object of the present invention is to provide a creosote removing chimney cleaner which may be easily and quickly attached to existing chimney structures.

Even another object of the present invention is to provide a creosote removing chimney cleaner that may be permanently attached to an existing chimney.

A still further object of the present invention is to provide a creosote removing chimney cleaner that may be operated by a user with a minimum of time and effort.

Even another object of the present invention is to provide a creosote removing chimney cleaner that will not interfere with the combustion gases being emitted from a chimney.

Still even a further object of the present invention is to provide a creosote removing chimney cleaner that may be alternatively operated from the inside or the outside of a dwelling depending on the bracket structure utilized.

Another even further object of the present invention is to provide a creosote removing chimney cleaner which may be effectively used to substantially reduce the danger of creosote fires within chimneys.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
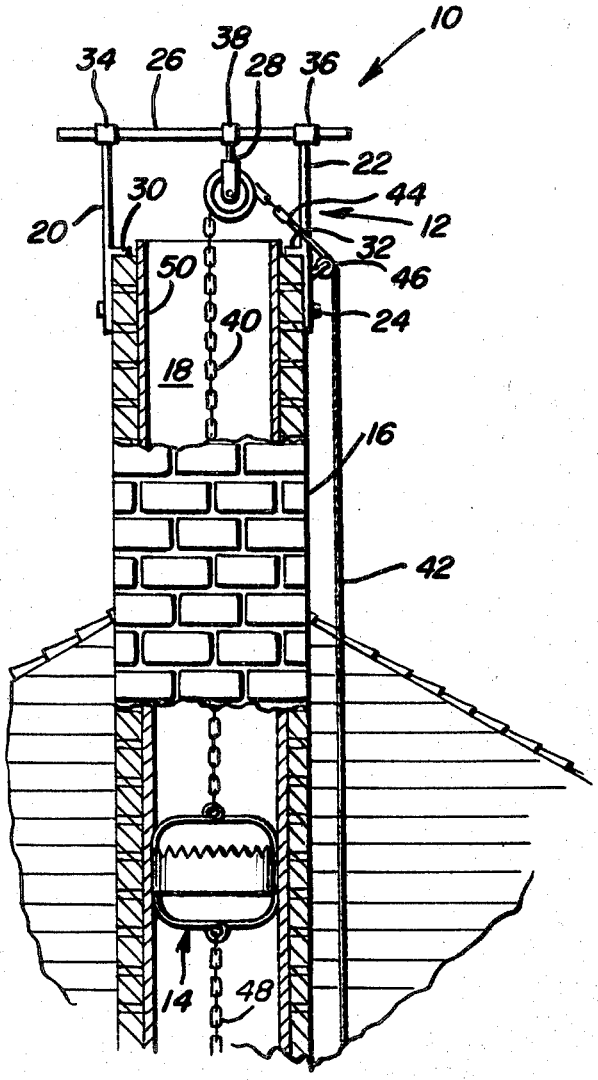
FIG. 1 is a plan view, partly in cross-section, illustrating a first embodiment of the creosote cutter assembly forming the present invention operably installed within a chimney.

With reference now to the drawings and in particular to FIG. 1 thereof, a first embodiment of the creosote cutter assembly embodying the principles and concepts of the present invention and generally designated by the reference numeral 10 will be described. In this respect, it can be seen that the creosote cutter assembly 10 includes a mounting bracket assembly 12 fixedly securable to the topmost portion of a chimney 16 and being operable to support a creosote cutter or cutter bar 14 normally positionable within an interior portion 18 of the chimney. In this regard, it can be seen that the mounting bracket assembly 12 includes the use of at least two upstanding support members 20, 22, which are fixedly securable to the topmost portion of the chimney 16 by a strip of banding iron 24 mountable about the chimney and fixedly securable thereto through the use of a conventional adjustable clamp. The upstanding support members 20, 22 may be further provided with a cross extending carrying bar 26 on which may be centrally suspended a pulley 28. Specifically, the upstanding support members 20, 22 may be constructed of any metallic material, such as angle iron, pipe, or the like, and may be further provided with laterally extending weight support projections 30, 32 respectively. In this connection, the projections 30, 32 may be welded or otherwise conventionally attached to the respective upstanding support members 20, 22. Cylindrically shaped nipples 34, 36 may then be welded or otherwise attached to the topmost portions of the respective support members 20, 22, with the through-extending apertures associated with such nipples being concentrically and axially aligned so as to permit the carrying bar 26 to be slidingly positioned through the respective apertures of the nipples and to be supported thereby in the manner illustrated. In this respect, the nipples 34, 36 might additionally be provided with circumferentially located apertures through which set screws or the like could be screwably inserted to lock the carrying bar 26 firmly in position once the same has been inserted through the nipples. Similarly, the pulley 28 could be hung from a nipple 38 which is slidably positionable over the carrying bar 26 and which may then be secured thereto through the use of a similar set screw or other securing means.

As is further evident from reference to FIG. 1, the creosote cutter 14 is suspended from the pulley 28 through the use of a metallic or fire resistant suspension means, such as chain 40, while a rope 42 may be attached to the free end 44 of the chain on an outside portion of the chimney 16. In this respect, the rope 42 may be used in those areas where no danger of fire damage might occur so as to lessen the weight associated with a pulling of the creosote cutter 14 up and down within the chimney interior 18. As illustrated, the support member 22 may be further provided with a small pulley or other guide 46 over which the rope 42 may be operably guided so as to prevent the same from scraping over the topmost portion of the chimney 16. The rope 42 may then be directed downwardly to the ground level whereby an operator may grasp the same to effect an up and down movement of the creosote cutter 14 within the chimney interior 18. Additionally illustrated in FIG. 1 is the use of a second downwardly extending or return chain 48 which is accessible from a bottommost portion of the chimney 16 and which may be utilized by an operator to effectively dislodge the creosote cutter 14 in the event that the same should become wedged within the chimney interior 18.

Figure 2:
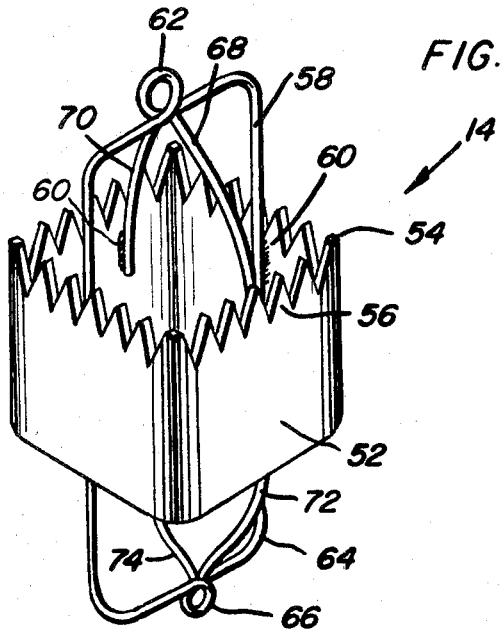
FIG. 2 is a perspective view illustrating one form of creosote cutter utilizable in the combination of the present invention.

As to the specific construction of the creosote cutter 14, reference is first made to FIG. 2 of the drawings wherein an embodiment of the creosote cutter designed for use in a square or rectangularly-shaped chimney flue 50 will be described. Specifically, it can be seen that the creosote cutter 14 may be constructed of a plate member 52 which is bent or otherwise shaped into a rectangular construction and which is then attached together by welding, or some other conventional attachment means, whereby a substantially rectangular member is formed. In this respect, no bottom or top members are provided within the rectangularly shaped aperture extending through the member 52, and a topmost portion or edge 54 is provided with a plurality of serrations 56 so as to present a ragged or serrated cutting edge for the removing of creosote from a chimney interior 18. A first support member 58 may be operably attached to the member 52 through the use of welding 60, or the like, such first support member typically consisting of bar stock operably bent into a shape which includes a loop 62 whereby the chain 40 may be connected thereto. A second support member 64 may be similarly attached to a bottommost portion of the cutting member 52 and may also be provided with a loop 66 formed therein whereby the dislodging or return chain 48 may be attached thereto. It should be noted with reference to FIG. 2 that the first and second support members 58, 64 are respectively welded to an interior portion of the cutting member 52 whereby the chance of interference between the support members and the flue 50 is minimized, thus to lessen the likelihood of the creosote cutter 14 becoming lodged or otherwise jammed within the chimney 16. Also illustrated in FIG. 2 is the use of a first pair of support bars 68, 70 which may be interiorly mounted within the creosote cutter 14 and which are attachable by welding or the like to the first support member 58 so as to provide additional structural support thereto. Similarly, a second pair of support bars 72, 74 may be interiorly attached to the plate member 52 and may be additionally attached to the second support member 64 so as to provide even further structural strength to the creosote cutter 14.

Figure 3:
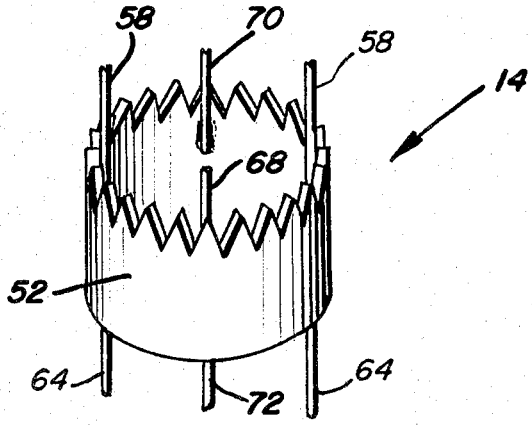
FIG. 3 is a perspective view illustrating a second form of the creosote cutter which may be utilized in the combination of the present invention.
Figure 5:
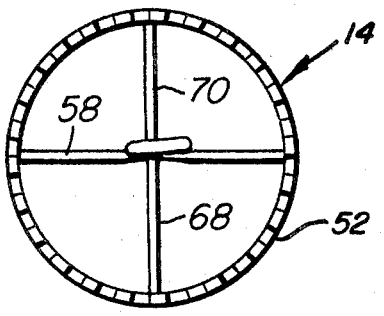
FIG. 5 is a top plan view of the form of the creosote cutter illustrated in FIG. 3.
Figure 4:
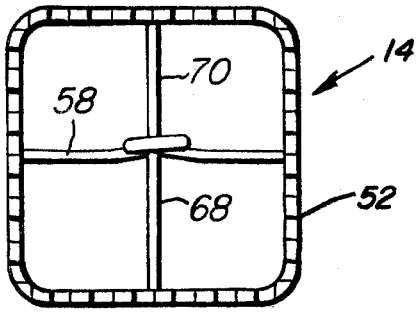
FIG. 4 is a top plan view of the form of the creosote cutter illustrated in FIG. 2.

FIG. 3 illustrates another embodiment of the creosote cutter 14 whereby the same is of a circular construction. In this connection, it can be appreciated that a number of different types of coal, wood and oil burning stoves or fireplaces utilize circular chimneys, and thus the embodiment of the present invention illustrated in FIG. 3 demonstrates the versatility and flexibility thereof for use in any type or shape of chimney flue 50. Specifically, the construction of the embodiment of FIG. 3 is analogous to that of FIG. 2, with the exception that the plate member 52 has been bent into a circular shape. FIGS. 4 and 5 illustrate the inside attachment of the support members 58, 64 and 68, 70, 72, 74, within the respective embodiments of the creosote cutter 14 illustrated in FIGS. 2 and 3. In this respect, it can be seen that all of the support structure of the creosote cutter 14 is interiorly attached thereto, whereby the exterior or outside surface of the plate member 52 may abut against a chimney flue 50 in an unencumbered manner. FIGS. 4 and 5 further illustrate the fact that the interior portion of the creosote cutter 14 is essentially of an open construction whereby smoke and other combustion gases may freely flow through the interior portion without any substantial interference. As such, it can be appreciated that the creosote cutter 14 may be permanently installed within the chimney interior 18, whether or not a fire and its attendant exhaust gases are present.

Figure 6:
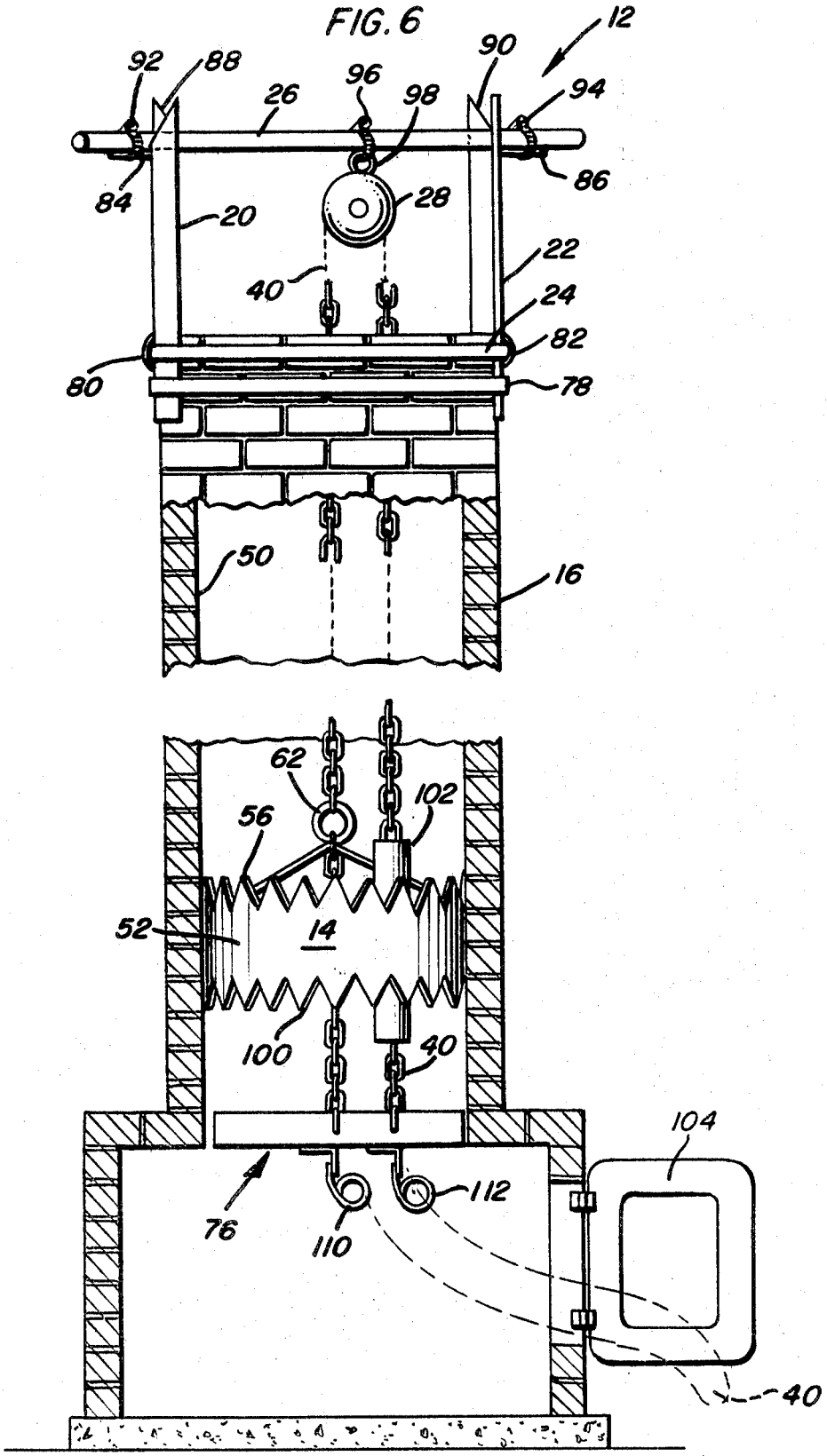
FIG. 6 is a plan view, partly in cross-section, illustrating a second embodiment of the creosote cutter assembly forming the present invention operably installed within a chimney.

Whereas the embodiment of the creosote cutter assembly 10 illustrated in FIG. 1 is specifically designed for operable manipulation from outside of a chimney 16 through the use of rope 42, a second embodiment of the creosote cutter assembly is illustrated in FIG. 6 whereby the same may be operably manipulated from an interior portion of a dwelling. Specifically, the embodiment illustrated in FIG. 6 may be operated from the firebox area of a chimney 16 and no need exists for an operator to go outside of the building structure to operate the same. In this construction of the present invention, use is made of an interior bracket support assembly 76, as well as an uppermost located mounting bracket assembly 12. Additionally, the mounting bracket assembly 12 is of a modified construction from the assembly illustrated in the embodiment of FIG. 1. Of course, it is to be recognized that the mounting bracket assembly 12 may consist of either of the constructions illustrated in FIG. 1 and FIG. 6, whether or not such assemblies are utilized with an outside operated or inside operated creosote cutter assembly 10. More particularly, it can be seen that the mounting bracket assembly 12 illustrated in FIG. 6 may include a pair of upstanding support members 20, 22, which might be metallic pipe, angle iron or the like, and which may be banded to a chimney 16 through the use of a pair of banding iron strips 24, 78. Additionally, the support members 20, 22 may be respectively provided with slot guides 80, 82 through which the strip of banding iron 24 may be guided prior to the securing of the same by the use of a conventional adjustment clamp (not illustrated). The second strip 78 of banding iron provides even additional support to the bracket assembly 12, so as to substantially lessen the chance of disengagement of the assembly from the chimney 16.

As opposed to utilizing the nipples 34, 36 illustrated in the embodiment of FIG. 1, wedge shaped cuts 88, 90 may be provided on topmost portions of each of the support members 20, 22 and the pieces of metal formed from such cuts may be bent outwardly therefrom so as to form respective support projections 84, 86. In this regard, the projections 84, 86 lie proximate to and effectively serve to form the respective wedged slots 88, 90 when the projections are bent outwardly in the manner illustrated. As such, the carrying bar 26 may be supportedly positioned within the wedge shaped slots 88, 90, while a secure and fixed positioning thereof within the respective slots may be facilitated by an attachment of the carrying bar to the respective support projections 84, 86. In this connection, adjustable clamps 92, 94 may be slid over the respective ends of the carrying bar 26 and the associated projections 84, 86 to effect such a securing in a conventional and well known manner. Additionally, the pulley 28 may be centrally retained on the carrying bar 26 through the use of a further adjustable clamp 96. Specifically, the adjustable clamp 96 may be positioned through the support ring 98, which forms a part of the pulley 28, and about the carrying bar 26 so as to centrally position the pulley over the flue 50 in the desired manner.

FIG. 6 also illustrates a modified embodiment of the creosote cutter 14 which may be utilized in connection therewith. Specifically, the creosote cutter 14 illustrated in FIG. 6 might be of a rectangular construction as illustrated in FIG. 2, a circular construction as illustrated in FIG. 3, or of any other shape and construction which would conformably fit the specific shape of the flue 50 illustrated therein. Further, it can be seen that the creosote cutter 14 may include serrations 56 operably positioned on a topmost edge thereof and may further include serrations 100 on a bottom edge thereof. Of course, it is to be realized that the serrations 100 located on a bottommost edge of the creosote cutter 14 might also be provided on the outside creosote cutter assembly 10 as illustrated in FIG. 1. Further, it can be seen that a chain guide member 102, which might typically consist of a length of pipe operably attached to an inside surface of the cutting member 52, might be utilized to guide the chain 40 through the interior portion of the cutter 14 in a manner which lessens the likelihood of entanglement thereof. Specifically, it can be seen that the chain 40 in this embodiment is no longer directed to an outside portion of the chimney 16 whereby the same may be attached to a rope 42, but rather is now redirected over the pulley 28 and downwardly through the flue 50 through the chain guide member 102. In this respect, the chain 40 is of a continuous construction whereby the same may be directed outwardly through a cleanout door 104 in a manner which permits an operator to effectively grasp the same so as to operate the creosote cutter assembly 10. In this regard, the chain 48, as illustrated in FIG. 1, has been dispensed with, and the end of the chain not attached to the loop 62 is directed back up through the flue 50 and into engagement with the loop 62 as illustrated. As such, it can be appreciated that only one length of chain 40 needs to be employed in the construction of the invention as illustrated in this figure. Additionally, the second support member 64 and its attendant connection loop 66 have been dispensed with. Further, it can be appreciated that the chain guide member 102 then serves to displace the portion of the chain 40 passing through the guide member and that portion of the chain attached to the loop 62 so as to minimize the danger of entanglement, as above discussed.

Figure 7:
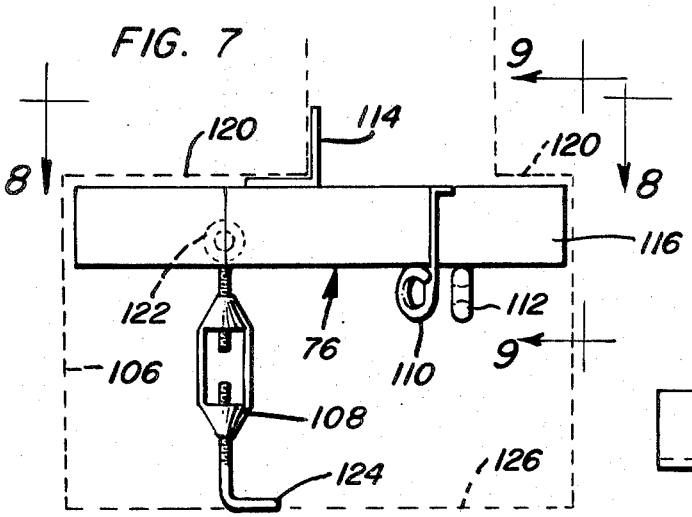
FIG. 7 is a longitudinal plan view of the lower bracket assembly forming a part of the combination of the second embodiment of the present invention.
Figure 9:
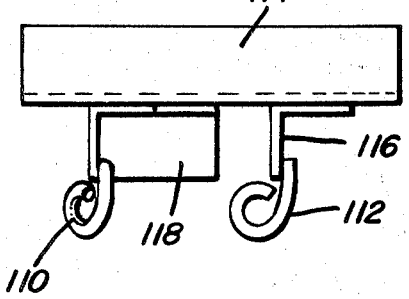
FIG. 9 is a transverse plan view taken along the line 9—9 of FIG. 7.
Figure 8:
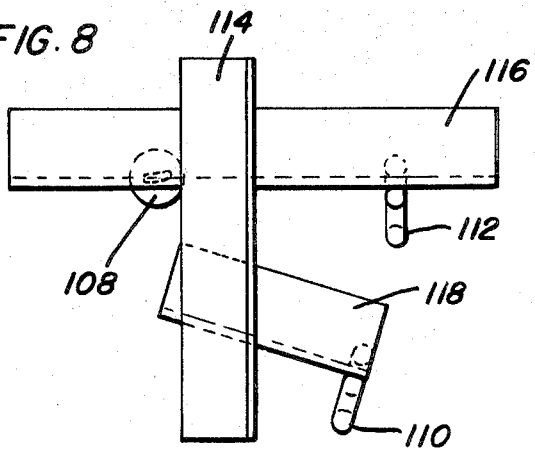
FIG. 8 is a top plan view of the lower bracket assembly illustrated in FIG. 7, as viewed in a plane passing substantially through the line 8—8 thereof.

As to the construction of the bottom interior support bracket assembly 76, reference is made to FIGS. 7–9 concurrently with FIG. 6. With particular reference to FIG. 7, it can be seen that the interior bracket assembly 76 is positionable within the firebox cleanout area 106, and includes an extensible eyebolt 108, as well as a pair of guide eyes or loops 110, 112. As clearly shown in FIGS. 7–9, the interior bracket assembly 76 further includes a first piece of angle iron 114, to which is operably attached by welding or other conventional attachment means second and third pieces of angle iron 116, 118 respectively. In this connection, the guide eye 110 is welded in the manner illustrated to the piece of angle iron 118, while the guide eye 112 is similarly operably attached to the angle iron 116. Also, as clearly illustrated in FIG. 7, the angle iron 116 is designed for abutment with a topmost wall portion 120 of the firebox 106 in a manner similar to which the angle iron 114 is in abutable engagement therewith. Inasmuch as the eyebolt 108 has its eye 122 welded to the angle iron 116, the same is screwably extensible in a conventional manner whereby the hook portion 124 of the eyebolt will lie in an abutting relationship with a bottom portion 126 of the cleanout box 106 as shown. In this respect, it can be appreciated that the eyebolt 108 then serves to retain the interior bracket support assembly 76 in a firm and secure position within the cleanout box 106. Referring again to FIG. 6 then, it can be seen that the guide eyes 110, 112 are retained in a spaced apart and fixed position whereby the chain 40 may be guidingly directed therethrough in a manner which prevents its entanglement with itself.

In operation then and with reference to FIG. 1 of the drawings, it can be appreciated that an operator need only to first position the two upstanding support members 20, 22 on a topmost portion of a chimney 16 and secure the same thereto by a strip of banding iron 24 connectible thereabout through the use of an unillustrated adjustable clamp. A carrying bar 26 may then be inserted through a pair of nipples 34, 36 attached to the respective topmost ends of the support members 20, 22 and at the same time through a nipple 38 to which a pulley 28 is attached. Through the use of unillustrated set screws circumferentially directed through the nipples 34, 36, 38, the carrying bar 26 may be secured in position relative to the support members 20, 22 and of course, the pulley 28 may be securely positioned over a flue 50. A chain 40 may then be attached to a loop 62 associated with a cutter bar or creosote cutter 14, and the chain may be directed over the pulley 28 and further be attached to a rope 42 as shown. Additionally, a return chain 48 may be attached to a loop 66 fixedly secured to a bottommost portion of the cutter bar 14, and as is apparent, the entire assembly of the described structure can be effected quite simply and quickly. An operator then, by utilizing the rope 42, can allow the weight of the cutter bar 14 to pull the same downwardly through the flue 50 and once the same is at bottommost portion of the chimney 16, the operator need only pull upon the rope 42 to effectively pull the cutter bar back upwardly through the flue, thus to dislodge accumulated creosote, carbon and other matter. By the same token, a release of the rope 42 permits the cutter bar 14 to again travel downwardly through the chimney 16, and in the event that the same should become lodged within the flue 50, the operator need only to reach into the firebox cleanout area 106 and grasp the return chain 48 to effectively pulls the cutter bar onwardly down through the flue. Once the cleanout operation has been completed, the cutter bar 14 may be permanently positioned at the bottommost portion of the chimney 16.

Figure 10:
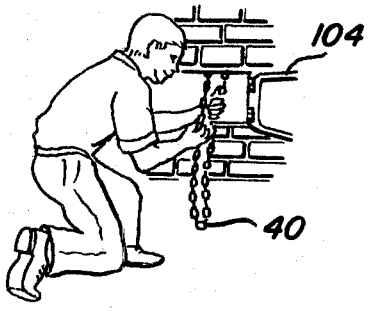
FIG. 10 is a perspective view illustrating the manner in which an operator would operate the second embodiment of the present invention.

With reference to the embodiment illustrated in FIG. 6, it can be seen that the mounting assembly 12 may be secured to the top of the chimney through the use of a pair of banding irons 24, 78, with band iron 24 being positioned through slot guides 80, 82. Again, adjustable clamps are utilized to attach the banding irons 24, 78 together so as to retain the upstanding support members 20, 22 in an abutting relationship with the topmost portion of the chimney 16, and the carrying bar 26 may be operably attached to the support members 20, 22 through the use of adjustable clamps 92, 94 respectively attachable to projections 84, 86. Additionally, the pulley 28 may be operably and centrally attached to carrying bar 26 through the use of an adjustable clamp 96 in the manner illustrated. The chain 40 may then be positioned over the pulley 28 and attached at one end thereof to the loop 62 associated with the cutter 14 and having the other end directed through a chain guide 102, a first guide eye 112 and second guide eye 110 before eventual attachment to the aforementioned loop 62. In this regard, the guide eyes 112, 110 are respectively associated with an interior support bracket assembly 76 which may be positioned in place within a firebox cleanout space 106 in the manner illustrated in FIG. 7. In this respect, reference is made to FIG. 10 wherein it can be seen that an operator need only to reach through a cleanout door 104 to effectively position the interior support bracket assembly 76 in the desired location and the extensible eyebolt 108 then may be screwably extended to effect a wedged and frictional engagement of the bracket assembly within the firebox cleanout area. Accordingly, an operator need only to grasp the chain 40, as illustrated in FIG. 10, to effectively move the cutter bar 14 up and down within the flue 50 so as to effect a creosote removing operation during both the up and down movement.

In summary then, it can be seen that a creosote cutter assembly 10 has been described which is designed for permanent mounting within a chimney, such assembly utilizing a topmost mounting bracket assembly which may be effectively attached to a chimney top without placing any strain upon a flue. As illustrated, the mounting may be secured by either one or two strands of steel bending with adjustable clamps, one of such strips of banding being threadable through slot guides on angle iron posts which support a carrying rod from diagonal corners of the chimney. As such, stress points are located on the outside of the chimney and not on the flue per se, as is the case with most prior art chimney cleaning structures, and of course, the mounting structure is adjustable to fit various sizes of chimneys. Additionally, the creosote cutter assembly forming the present invention may be stored in the bottom of a chimney at all times, or if desired, may be unfastened and stored anywhere for safe keeping. Further, the creosote cutter assembly above described is versatile in that it may be used on both outside or inside chimneys, and is always operable from a cleanout level, whether such level be at a dwelling's exterior ground level or the interior basement level. Accordingly, the simplicity of design and construction above described makes the creosote cutter assembly forming the present invention a feasible device for economical mass production.

As such, it can be further appreciated from the above discussion that the frame construction forming a part of the present invention is relatively simple to install. For example, the angle iron support frame, carrying bar, pulley, chain or rope and one or more banding supports may all be assembled on the ground and installed as a unit. The cutter bar may then be put in place and a chain stop installed. In this respect, the chain stop might be formed by the positioning of the pulley 28 quite close to the top of the flue 50 whereby the cutter bar 14 is prevented from completely emerging from the chimney flue. This of course is desirable since were the cutter bar to come completely out of the flue 50, it might be necessary for an operator to climb to the top of the chimney so as to reposition the cutter bar within the flue per se. Alternatively, a chain stop in the form of a guide eye might be positioned in front of the pulley 46, as illustrated in FIG. 1, or some other type of cross extending member could be positioned over the flue 50 to prevent the cutter bar 14 from emerging therefrom. As can be appreciated, the entire assembly process takes very little time and may be accomplished through the use of nothing more than a screwdriver. As has been further above described, the cutter bar or creosote cutter 14 may be made in round, rectangular or square shape, or any other desired shape, depending on the flue shape. Additionally, the cutter bar is of a hollow construction which enables the use of the present invention while a fire is burning in a stove or furnace. Through the use of the return chain 48, or alternatively the extensible length of operational chain 40 in the embodiment of FIG. 6, controlled movement of the cutter bar within the chimney during its return downwardly therein is facilitated. Should the cutter become lodged, the return chain can be pulled or manipulated to dislodge the same, and by using the operational chain in conjunction with the return chain, the operator has complete control of the cutter bar at all times. Desirably, allowance should be made for the cutter bar to protrude a short distance out of the top of the chimney flue so that the rim of the flue may also be cleaned.

With respect to the above description then, it should be realized that the optimum dimensional relationships for the parts of the invention, to include variations in size, shape, form, function and manner of operation, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new and desired to be secured by Letters Patent of the United States is as follows:

1. A chimney cleaning apparatus for removing accumulations of creosote, carbon and the like from an interior flue portion of a chimney, said apparatus comprising:

cutter bar means operably movable within said flue portion to effect said removing of said accumulations, said cutter bar means being provided with a substantially hollow interior portion so as to permit smoke and other products of combustion to travel through and past said cutter bar means, thereby to permit said cutter bar means to be permanently retained within said flue portion of said chimney while a combustion process is occurring therein, said cutter bar means further including a suspension line support means positioned substantially centrally within said hollow interior portion of said cutter bar means and a suspension line guide means fixedly secured to said cutter bar means, said cutter bar means further including serrated edges to further facilitate said removing of said accumulations, said serrated edges including two independent sets of serrations respectively provided on topmost and bottommost edges of said cutter bar means, said serrations being substantially oppositely directed from one another on said topmost and bottommost edges of said cutter bar means, such direction of said two independent sets of serrations resulting in said serrations pointing in an axial direction of movement of said cutter bar means;

mounting bracket means attachable by banding means to a topmost portion of said chimney, said mounting bracket means including upstanding support means directly attachable to said topmost portion of said chimney, and carrying bar means fixedly securable to said upstanding support means, said carrying bar means extending across said topmost portion of said chimney and having a pulley means substantially centrally attached thereto;

suspension means operably associated with said pulley means and serving to both support and facilitate a movement of said cutter bar means within said flue portion, said suspension means including a length of fire-resistant line having first and second ends, said first and second ends being respectively attached to said suspension line support means so as to form a continuous loop, with said loop being directed through said pulley means and said suspension line guide means; and interior bracket support means selectively fixedly securable within a bottommost interior flue portion of said chimney, said interior bracket support means including first and second guide means through which said loop is guidingly directed, thereby to facilitate a movement of said loop while substantially reducing a likelihood of entanglement, thus to permit said operator to move said cutter bar means in both up and down directions within said flue portion of said chimney.

2. The chimney cleaning apparatus as defined in claim 1, and further including adjustable support means operably attached to said interior bracket support means, said adjustable support means facilitating a positioning and fixed retention of said interior bracket support means withing said bottommost flue portion of said chimney.

3. A chimney cleaning apparatus for removing accumulations of creosote, carbon and the like from an interior flue portion of a chimney, said apparatus comprising:

cutter bar means operably movable within said flue portion to effect said removing of said accumulations, said cutter bar means being provided with a substantially hollow interior portion so as to permit smoke and other products of combustion to travel through and past said cutter bar means, thereby to permit said cutter bar means to be permanently retained within said flue portion of said chimney while a combustion process is occurring therein, said cutter bar means further including first and second suspension line support means operably attached to said cutter bar means and positioned substantially centrally within said hollow interior portion of said cutter bar means, said cutter bar means further including serrated edges to further facilitate said removing of said accumulations, said serrated edges including two independent sets of serrations respectively provided on topmost and bottommost edges of said cutter bar means, said two independent sets of serrations being substantially oppositely directed from one another on said topmost and bottommost edges of said cutter bar means, such direction of two independent sets of serrations resulting in said serrations pointing in an axial direction of movement of said cutter bar means;

mounting bracket means attachable by banding means to a topmost portion of said chimney, said mounting bracket means including upstanding support means directly attachable to said topmost portion of said chimney, and carrying bar means fixedly securable to said upstanding support means, said carrying bar means extending across said topmost portion of said chimney and having a pulley means substantially centrally attached thereto;

suspension means operably associated with said pulley means and serving to both support and facilitate a movement of said cutter bar means within said flue portion, said suspension means including a length of fire-resistant line having first and second ends, said first end being operably attached to said first suspension line support means associated with said cutter bar means and said second and being remotely located externally of said chimney, whereby a user may grasp said second end to operably move said cutter bar means upwardly in said flue portion, said suspension means being constructed of a first length of metallic chain normally retained within said flue portion of said chimney, said first end being located on said chain, and a second length of non-metallic rope operably attached to a remaining end of said chain and being normally retained externally of said chimney and having said second end contained thereon;

second pulley means operably attached to said mounting bracket means and positioned externally of said chimney, said suspension means being directed through said pulley means and further through said second pulley means, said pulley means being designed to facilitate traversing movement of both said chain and said rope and said second pulley means being designed to facilitate movement of said rope, and return suspension means operably attached to said second suspension line support means associated with said cutter bar means, said return suspension means being directed downwardly within said flue portion to facilitate a grasping thereof by a user of said chimney cleaning apparatus, whereby said user may pull on said return suspension means to facilitate a downward movement of said cutter bar means within said flue portion after said cutter bar means has been moved upwardly towards a topmost portion of said flue portion during a creosote removing operation.

4. The chimney cleaning apparatus as defined in claim 3, wherein said upstanding support means associated with said mounting bracket means include downwardly-extending legs across which said banding means may be wrapped to effect a retention of said upstanding support means proximate said chimney and further includes transverse extending means abuttable with a topmost horizontal surface of said chimney for preventing an undesired downward sliding movement of said upstanding support means relative to said chimney, said upstanding support means further including cylindrically-shaped carrying bar retention means, said carrying bar means being slidably directable through said carrying bar support means whereby said carrying bar means is then positioned over a topmost opening portion of said chimney, said pulley means being slidably positionable along said carrying bar means over said topmost portion of said chimney.

* * * * *